US008046950B2

(12) United States Patent
Holmberg

(10) Patent No.: US 8,046,950 B2
(45) **Date of Patent: *Nov. 1, 2011**

(54) METHOD OF ATTACHING DEVICE TO WEAPON

(76) Inventor: Larry Holmberg, Harrisburg, SD (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/459,704

(22) Filed: Jul. 7, 2009

(65) Prior Publication Data

US 2010/0018103 A1 Jan. 28, 2010

Related U.S. Application Data

(62) Division of application No. 11/327,123, filed on Jan. 6, 2006, now Pat. No. 7,574,824.

(51) Int. Cl.
*F41C 27/00* (2006.01)

(52) U.S. Cl. ..... 42/106; 42/124; 396/419

(58) Field of Classification Search ..... 42/124, 42/125, 126, 127, 148, 106; 89/41.05; 396/419
See application file for complete search history.

(56) References Cited

U.S. PATENT DOCUMENTS

| | | | |
|---|---|---|---|
| 521,761 | A | 6/1894 | Day |
| 547,912 | A | 10/1895 | Crupe |
| 619,214 | A | 2/1899 | Paul |
| 674,229 | A | 5/1901 | Windle |
| 845,165 | A | 2/1907 | Davis |
| 899,639 | A | 9/1908 | Vibber |
| 1,452,651 | A | 4/1923 | Norrlin |
| 1,480,147 | A | 1/1924 | Brandt |
| 1,550,849 | A | 8/1925 | Szalardi |
| 1,735,164 | A | 11/1929 | Green |
| 1,757,244 | A | 5/1930 | Green |
| 1,923,926 | A | 8/1933 | Faure-Roux |
| 2,072,387 | A | 3/1937 | Sneed |
| 2,101,479 | A | 12/1937 | Schenk |
| 2,129,606 | A | 9/1938 | Nisenson |
| 2,270,902 | A | 1/1942 | Rubissow |
| 2,296,308 | A | 9/1942 | Rand |
| 2,354,998 | A | 8/1944 | Ku |
| 2,416,769 | A | 3/1947 | Palmer |

(Continued)

FOREIGN PATENT DOCUMENTS

EP 1804017 A1 7/2007

(Continued)

OTHER PUBLICATIONS

Improved Construction Methods, "Laser Measuring System, Impulse LX", http://www.improvedconstructionmethods.com/impulse_xl.htm.

(Continued)

*Primary Examiner* — Benjamin P Lee
(74) *Attorney, Agent, or Firm* — Kinney & Lange, P.A.

(57) ABSTRACT

A mount for mounting a device to a firearm that includes a side plate, a support plate and a mounting rail. The side plate has a first end and a second end. The support plate extends from the first end of the side plate at approximately a right angle. Moreover, the support plate is adapted to support a device resting thereon. The mounting rail is coupled to the second end of the side plate. In addition, the mounting rail extends out from the side plate in a direction that is approximately opposite the direction the support plate extends from the side plate.

20 Claims, 13 Drawing Sheets

U.S. PATENT DOCUMENTS

| | | | | | |
|---|---|---|---|---|---|
| 2,450,466 | A | | 10/1948 | Carlson | |
| 2,456,554 | A | | 12/1948 | Churchill | |
| 2,483,711 | A | * | 10/1949 | Roos | 396/426 |
| 2,576,007 | A | | 11/1951 | Fischer et al. | |
| 2,604,933 | A | | 7/1952 | Karg | |
| 2,664,797 | A | * | 1/1954 | Thrasher | 396/426 |
| 2,814,118 | A | | 11/1957 | Evans et al. | |
| 2,817,233 | A | | 12/1957 | Dower et al. | |
| 2,943,547 | A | | 7/1960 | Martin | |
| 3,035,880 | A | | 5/1962 | Hitchcock | |
| 3,062,114 | A | | 11/1962 | Palos | |
| 3,065,666 | A | | 11/1962 | Sampson | |
| 3,078,728 | A | | 2/1963 | Schlesman | |
| 3,165,972 | A | | 1/1965 | Cumbo | |
| 3,371,899 | A | | 3/1968 | Johnson | |
| 3,427,102 | A | | 2/1969 | Wade | |
| 3,483,623 | A | | 12/1969 | Kruzell | |
| 3,502,062 | A | | 3/1970 | Shurts | |
| 3,545,356 | A | * | 12/1970 | Nielsen | 396/426 |
| 3,684,376 | A | | 8/1972 | Lessard | |
| 3,684,378 | A | | 8/1972 | Lord | |
| 3,737,232 | A | | 6/1973 | Millburn, Jr. | |
| 3,782,822 | A | | 1/1974 | Spence | |
| 3,785,261 | A | | 1/1974 | Ganteaume | |
| 3,834,052 | A | | 9/1974 | Steck, III | |
| 3,945,134 | A | | 3/1976 | Ramer | |
| 3,986,285 | A | | 10/1976 | Krisay | |
| 4,000,403 | A | | 12/1976 | Rice | |
| 4,026,054 | A | | 5/1977 | Snyder | |
| 4,027,414 | A | | 6/1977 | Felix | |
| 4,069,414 | A | | 1/1978 | Bell | |
| 4,162,696 | A | * | 7/1979 | Sprung | 206/316.2 |
| 4,223,770 | A | | 9/1980 | Kranz | |
| 4,234,112 | A | | 11/1980 | Gallant | |
| 4,283,743 | A | | 8/1981 | Kaiser | |
| T101,001 | I4 | | 9/1981 | Shipp et al. | |
| D261,545 | S | | 10/1981 | Holmberg | |
| 4,296,725 | A | | 10/1981 | Broderick | |
| 4,309,095 | A | * | 1/1982 | Buckley | 396/420 |
| 4,316,342 | A | | 2/1982 | Griggs | |
| 4,349,169 | A | | 9/1982 | McAnally | |
| D268,910 | S | | 5/1983 | Shipp et al. | |
| 4,439,032 | A | * | 3/1984 | Congdon | 396/419 |
| 4,514,907 | A | | 5/1985 | Saltzman | |
| 4,516,296 | A | | 5/1985 | Sherman | |
| 4,531,052 | A | | 7/1985 | Moore | |
| 4,561,204 | A | | 12/1985 | Binion | |
| 4,564,322 | A | | 1/1986 | Stapley | |
| 4,597,211 | A | | 7/1986 | Miles | |
| 4,606,629 | A | | 8/1986 | Hines et al. | |
| 4,617,741 | A | | 10/1986 | Bordeaux et al. | |
| 4,640,258 | A | | 2/1987 | Penney et al. | |
| 4,643,159 | A | | 2/1987 | Ryan | |
| 4,730,190 | A | | 3/1988 | Win et al. | |
| 4,753,528 | A | | 6/1988 | Hines et al. | |
| 4,777,352 | A | | 10/1988 | Moore | |
| 4,786,204 | A | | 11/1988 | Mayeda | |
| 4,786,966 | A | | 11/1988 | Hanson et al. | |
| 4,827,348 | A | | 5/1989 | Ernest et al. | |
| 4,835,621 | A | | 5/1989 | Black | |
| 4,884,137 | A | | 11/1989 | Hanson et al. | |
| 4,890,128 | A | | 12/1989 | Kania | |
| 4,907,567 | A | | 3/1990 | Henrich | |
| 4,910,717 | A | | 3/1990 | Terry | |
| 4,939,863 | A | | 7/1990 | Alexander et al. | |
| 4,970,589 | A | | 11/1990 | Hanson et al. | |
| 4,974,575 | A | | 12/1990 | Mitchell | |
| D313,361 | S | | 1/1991 | Robinson | |
| 4,989,024 | A | | 1/1991 | Myers | |
| 4,993,833 | A | | 2/1991 | Lorey et al. | |
| 4,996,866 | A | | 3/1991 | Masera et al. | |
| 5,005,213 | A | | 4/1991 | Hanson et al. | |
| 5,020,262 | A | | 6/1991 | Pena | |
| 5,026,158 | A | | 6/1991 | Golubic | |
| 5,033,219 | A | | 7/1991 | Johnson et al. | |
| 5,035,390 | A | | 7/1991 | Sanders | |
| 5,056,410 | A | | 10/1991 | Pitts | |
| 5,113,745 | A | | 5/1992 | Allen | |
| 5,121,147 | A | | 6/1992 | Wada et al. | |
| 5,161,310 | A | | 11/1992 | Stoot | |
| 5,200,827 | A | | 4/1993 | Hanson et al. | |
| 5,244,430 | A | | 9/1993 | Legursky | |
| 5,262,837 | A | | 11/1993 | Shyy | |
| 5,265,896 | A | | 11/1993 | Kravitz | |
| 5,297,533 | A | | 3/1994 | Cook | |
| 5,326,061 | A | | 7/1994 | Hamilton | |
| 5,339,793 | A | | 8/1994 | Findley | |
| 5,373,657 | A | | 12/1994 | Betz et al. | |
| 5,418,609 | A | | 5/1995 | Dunne | |
| 5,450,993 | A | | 9/1995 | Guerrero et al. | |
| 5,455,625 | A | | 10/1995 | Englander | |
| 5,456,157 | A | | 10/1995 | Lougheed et al. | |
| 5,479,712 | A | | 1/1996 | Hargrove et al. | |
| 5,507,272 | A | | 4/1996 | Scantlen | |
| 5,520,164 | A | | 5/1996 | Huddleston | |
| D371,084 | S | | 6/1996 | Ogawa | |
| 5,528,325 | A | | 6/1996 | Perez | |
| 5,531,149 | A | | 7/1996 | Schubert et al. | |
| 5,555,665 | A | | 9/1996 | Fore | |
| 5,575,072 | A | | 11/1996 | Eldridge | |
| 5,606,818 | A | | 3/1997 | Hardee | |
| 5,607,091 | A | | 3/1997 | Musacchia | |
| 5,611,324 | A | | 3/1997 | Kursinsky | |
| 5,669,147 | A | | 9/1997 | Nakajima et al. | |
| 5,669,174 | A | | 9/1997 | Teetzel | |
| 5,686,690 | A | | 11/1997 | Lougheed et al. | |
| 5,687,910 | A | | 11/1997 | King | |
| 5,711,104 | A | | 1/1998 | Schmitz | |
| D390,483 | S | | 2/1998 | Zykan et al. | |
| 5,739,859 | A | | 4/1998 | Hattori et al. | |
| 5,806,228 | A | * | 9/1998 | Martel et al. | 42/124 |
| 5,811,720 | A | | 9/1998 | Quinnell et al. | |
| 5,815,251 | A | | 9/1998 | Ehbets et al. | |
| 5,822,621 | A | | 10/1998 | Szajewski | |
| 5,831,718 | A | | 11/1998 | Desai et al. | |
| 5,834,676 | A | | 11/1998 | Elliott | |
| 5,845,165 | A | | 12/1998 | McMahan | |
| 5,859,693 | A | | 1/1999 | Dunne et al. | |
| 5,887,375 | A | * | 3/1999 | Watson | 42/106 |
| 5,892,617 | A | | 4/1999 | Wallace | |
| 5,895,131 | A | | 4/1999 | Yano | |
| 5,911,215 | A | | 6/1999 | Fisher, Jr. | |
| 5,926,260 | A | | 7/1999 | Dunne et al. | |
| 5,937,562 | A | | 8/1999 | Brough | |
| 5,941,434 | A | | 8/1999 | Green | |
| 5,944,041 | A | | 8/1999 | Kitchens | |
| 5,949,529 | A | | 9/1999 | Dunne et al. | |
| 5,963,748 | A | | 10/1999 | Glasson | |
| 5,964,054 | A | | 10/1999 | Galfidi, Jr. | |
| 5,973,315 | A | | 10/1999 | Saldana et al. | |
| D421,229 | S | | 2/2000 | Imai | |
| 6,029,643 | A | | 2/2000 | Golfieri | |
| 6,070,355 | A | | 6/2000 | Day | |
| 6,073,352 | A | | 6/2000 | Zykan et al. | |
| D432,930 | S | | 10/2000 | Sanoner | |
| 6,137,564 | A | | 10/2000 | Schmidt et al. | |
| 6,154,971 | A | | 12/2000 | Perkins | |
| 6,192,614 | B1 | * | 2/2001 | Cliburn | 42/106 |
| 6,252,706 | B1 | | 6/2001 | Kaladgew | |
| 6,269,581 | B1 | | 8/2001 | Groh | |
| 6,286,796 | B1 | | 9/2001 | Pugliesi | |
| 6,288,386 | B1 | | 9/2001 | Bowen et al. | |
| 6,296,581 | B1 | | 10/2001 | Sever | |
| 6,304,289 | B1 | | 10/2001 | Sakai et al. | |
| 6,331,887 | B1 | | 12/2001 | Shiraishi et al. | |
| 6,336,285 | B1 | | 1/2002 | Baumer | |
| 6,341,201 | B1 | | 1/2002 | Ishiguro et al. | |
| 6,396,571 | B2 | | 5/2002 | Ohtomo et al. | |
| 6,397,483 | B1 | | 6/2002 | Perkins | |
| 6,398,571 | B1 | | 6/2002 | Nishide et al. | |
| 6,408,140 | B1 | | 6/2002 | Desormeaux | |
| D460,367 | S | | 7/2002 | Apotheloz et al. | |
| D460,368 | S | | 7/2002 | Apotheloz et al. | |
| D460,369 | S | | 7/2002 | Apotheloz et al. | |
| 6,425,697 | B1 | * | 7/2002 | Potts et al. | 396/426 |
| 6,450,816 | B1 | | 9/2002 | Gerber | |
| 6,487,809 | B1 | | 12/2002 | Gaber | |

| | | | | |
|---|---|---|---|---|
| 6,494,196 | B2 | 12/2002 | Harwath et al. | |
| 6,526,956 | B1 | 3/2003 | Hankins | |
| D472,826 | S | 4/2003 | Sanoner | |
| 6,556,245 | B1 | 4/2003 | Holmberg | |
| 6,598,331 | B1 | 7/2003 | Thibodeaux | |
| 6,615,531 | B1 | 9/2003 | Holmberg | |
| 6,623,182 | B2 | 9/2003 | Tatera | |
| 6,624,881 | B2 | 9/2003 | Waibel et al. | |
| 6,678,988 | B1 | 1/2004 | Poff, Jr. | |
| 6,681,755 | B2 | 1/2004 | Pujos | |
| 6,693,702 | B2 | 2/2004 | Rogers | |
| 6,704,097 | B2 | 3/2004 | Waibel et al. | |
| D488,315 | S | 4/2004 | Natuzzi | |
| 6,722,076 | B2 | 4/2004 | Nielsen | |
| 6,742,299 | B2 | 6/2004 | Strand | |
| 6,772,076 | B2 | 8/2004 | Yamamoto et al. | |
| 6,784,920 | B2 | 8/2004 | Weber | |
| 6,796,038 | B2 | 9/2004 | Humphries | |
| 6,813,025 | B2 | 11/2004 | Edwards | |
| 6,815,251 | B1 | 11/2004 | Akram et al. | |
| 6,819,495 | B2 | 11/2004 | Shani et al. | |
| 6,819,866 | B2 | 11/2004 | Da Silva | |
| 6,886,288 | B1 * | 5/2005 | Yocum et al. | 42/127 |
| 6,932,305 | B2 | 8/2005 | Morales et al. | |
| 6,988,331 | B2 | 1/2006 | Holmberg | |
| 7,006,114 | B2 | 2/2006 | Sakaguchi | |
| 7,088,506 | B2 | 8/2006 | Regan et al. | |
| 7,128,354 | B2 * | 10/2006 | Wu | 294/139 |
| 7,269,920 | B2 | 9/2007 | Staley, III | |
| 7,390,130 | B2 | 6/2008 | Soulvie | |
| 7,594,352 | B2 | 9/2009 | Holmberg | |
| 7,614,805 | B2 * | 11/2009 | Showalter | 396/428 |
| 7,789,574 | B2 * | 9/2010 | Broberg | 396/428 |
| 2001/0018311 | A1 | 8/2001 | Musacchia | |
| 2001/0035440 | A1 | 11/2001 | Danielson | |
| 2002/0067475 | A1 | 6/2002 | Waibel et al. | |
| 2002/0078577 | A1 | 6/2002 | Aldred | |
| 2002/0087475 | A1 | 7/2002 | Okayama et al. | |
| 2002/0109057 | A1 | 8/2002 | Wooten et al. | |
| 2002/0171755 | A1 | 11/2002 | Nishimura | |
| 2003/0013392 | A1 | 1/2003 | Guillermin | |
| 2003/0133092 | A1 | 7/2003 | Rogers | |
| 2003/0163943 | A1 | 9/2003 | Holmberg | |
| 2003/0168484 | A1 | 9/2003 | Gates et al. | |
| 2004/0000083 | A1 | 1/2004 | Grant, Jr. | |
| 2004/0016169 | A1 | 1/2004 | Poff, Jr. | |
| 2004/0051865 | A1 | 3/2004 | Stierle et al. | |
| 2004/0079018 | A1 | 4/2004 | Holmberg | |
| 2004/0114129 | A1 | 6/2004 | Gogolla et al. | |
| 2004/0135991 | A1 | 7/2004 | Gogolla et al. | |
| 2004/0183942 | A1 | 9/2004 | Holmberg | |
| 2004/0194364 | A1 | 10/2004 | Holmberg | |
| 2004/0257437 | A1 * | 12/2004 | Lesseu | 348/61 |
| 2005/0035245 | A1 | 2/2005 | Morales et al. | |
| 2005/0123883 | A1 | 6/2005 | Kennen et al. | |
| 2005/0195385 | A1 | 9/2005 | Holmberg | |
| 2005/0241210 | A1 | 11/2005 | Karcher et al. | |
| 2005/0246910 | A1 | 11/2005 | Mowers | |
| 2005/0252062 | A1 | 11/2005 | Scrogin et al. | |
| 2005/0268519 | A1 | 12/2005 | Pikielny | |
| 2005/0268521 | A1 | 12/2005 | Cox et al. | |
| 2006/0010761 | A1 | 1/2006 | Staley, III | |
| 2006/0215149 | A1 | 9/2006 | LaBelle et al. | |
| 2007/0008187 | A1 | 1/2007 | Schmidt | |
| 2007/0031142 | A1 | 2/2007 | Moody et al. | |
| 2007/0068018 | A1 | 3/2007 | Gilmore | |
| 2007/0081817 | A1 | 4/2007 | Soulvie | |
| 2007/0125930 | A1 | 6/2007 | Tsai | |
| 2007/0130848 | A1 | 6/2007 | Tsai | |
| 2007/0157502 | A1 | 7/2007 | Holmberg | |
| 2007/0157503 | A1 | 7/2007 | Holmberg | |
| 2007/0277421 | A1 | 12/2007 | Perkins et al. | |
| 2008/0000463 | A1 | 1/2008 | Holmberg | |
| 2008/0000465 | A1 | 1/2008 | Holmberg | |
| 2008/0060248 | A1 | 3/2008 | Pine et al. | |
| 2008/0087784 | A1 | 4/2008 | Holmberg | |

FOREIGN PATENT DOCUMENTS

| | | | |
|---|---|---|---|
| GB | 2024558 | A | 1/1980 |
| GB | 2114770 | A | 8/1983 |
| WO | WO9012330 | | 10/1990 |
| WO | WO2006090356 | A1 | 8/2006 |
| WO | WO2006133029 | A2 | 12/2006 |

OTHER PUBLICATIONS

"Specification Sheet on the Impulse 200 LR Laser (Rangefinder)," Nov. 15, 2003, Publisher: Laser Technology Inc.

* cited by examiner

METHOD OF ATTACHING DEVICE TO WEAPON

CROSS-REFERENCE TO RELATED APPLICATION(S)

This application is a divisional of U.S. patent application Ser. No. 11/327,123, entitled "Device Mount for a Firearm" and filed Jan. 6, 2006.

BACKGROUND

For game hunters the ability to record the hunt in an efficient manner is desired. Moreover, the ability to attach other devices such as rangefinders and other electronic device to the weapon in a manner that does not impede the hunt is also desired. For the reasons stated above and for other reasons stated below which will become apparent to those skilled in the art upon reading and understanding the present specification, there is a need in the art for a mount that can attach a device such an electronic device to a weapon in an effective and un-intrusive manner.

SUMMARY

The above-mentioned problems of current systems are addressed by embodiments of the present invention and will be understood by reading and studying the following specification.

In one embodiment, a mount for a device is provided. The mount includes a side plate, a support plate and a mounting rail. The side plate has a first end and a second end. The support plate extends from the first end of the side plate at approximately a right angle. Moreover, the support plate is adapted to support a device resting thereon. The mounting rail is coupled to the second end of the side plate. In addition, the mounting rail extends out from the side plate in a direction that is approximately opposite the direction the support plate extends from the side plate.

In another embodiment, a device mounting rail is provided. The device mounting rail includes a plate, a first rail and a second rail. The plate has a first edge and a second edge. The plate also has a mounting aperture positioned between the first edge and the second edge. In addition, the plate further has a plurality of attaching apertures positioned between the first edge and second edge. The first rail extends from the plate along the first edge of the plate. The second rail extends from the plate along the second edge of the plate in the same direction as the first rail.

In yet another embodiment, a rangefinder having a housing is provided. The housing has a bottom end. The bottom end has a threaded recess and plurality of mounting rail attaching apertures that are adapted to be used to attach a mounting rail to the bottom end of the housing, wherein the threaded recess is aligned with an aperture in the mounting rail when the mounting rail is attached to the rangefinder.

In still another embodiment, a method of attaching a device to a firearm is provided. The method comprises attaching a mounting rail to the device and attaching the mounting rail to a scope mount.

In still further another embodiment, a method of attaching a device to a firearm is provided. The method comprises attaching the device to a mount and attaching a mounting rail of the mount to at least one scope mount, wherein when the device is attached to the firearm the visual operation of the device is approximately at eye level with an aiming mechanism of the scope.

In finally another embodiment, a system to mount a device to a firearm is provided. The system includes a means to attach a device to a mount and a means to attach the mount to the firearm such that a visual operation of the device is essentially at eye level with an aiming device of the scope.

BRIEF DESCRIPTION OF THE DRAWINGS

The present invention can be more easily understood and further advantages and uses thereof more readily apparent, when considered in view of the description of the preferred embodiments and the following figures in which.

In accordance with common practice, the various described features are not drawn to scale but are drawn to emphasize specific features relevant to the present invention. Reference characters denote like elements throughout Figures and text.

DETAILED DESCRIPTION

In the following detailed description, reference is made to the accompanying drawings, which form a part hereof, and in which is shown by way of illustration specific embodiments in which the inventions may be practiced. These embodiments are described in sufficient detail to enable those skilled in the art to practice the invention, and it is to be understood that other embodiments may be utilized and that logical, mechanical and electrical changes may be made without departing from the spirit and scope of the present invention. The following detailed description is, therefore, not to be taken in a limiting sense, and the scope of the present invention is defined only by the claims and equivalents thereof.

Embodiments of the present invention provide a mount that allows for the attachment of a device such as a video camera, rangefinder or the like, to a weapon. In particular, in one embodiment, the mount allows the device to be mounted to a scope of a weapon in a manner that does not hamper the operation of the scope (i.e. the elevation and/or windage adjustment knob for example) or other operations of the weapon. In another embodiment, a mounting rail adapted to mount a device to a firearm. In yet another embodiment, a rangefinder having a remote port and attaching treads that can be attached to the mount is provided.

Figure 1A:
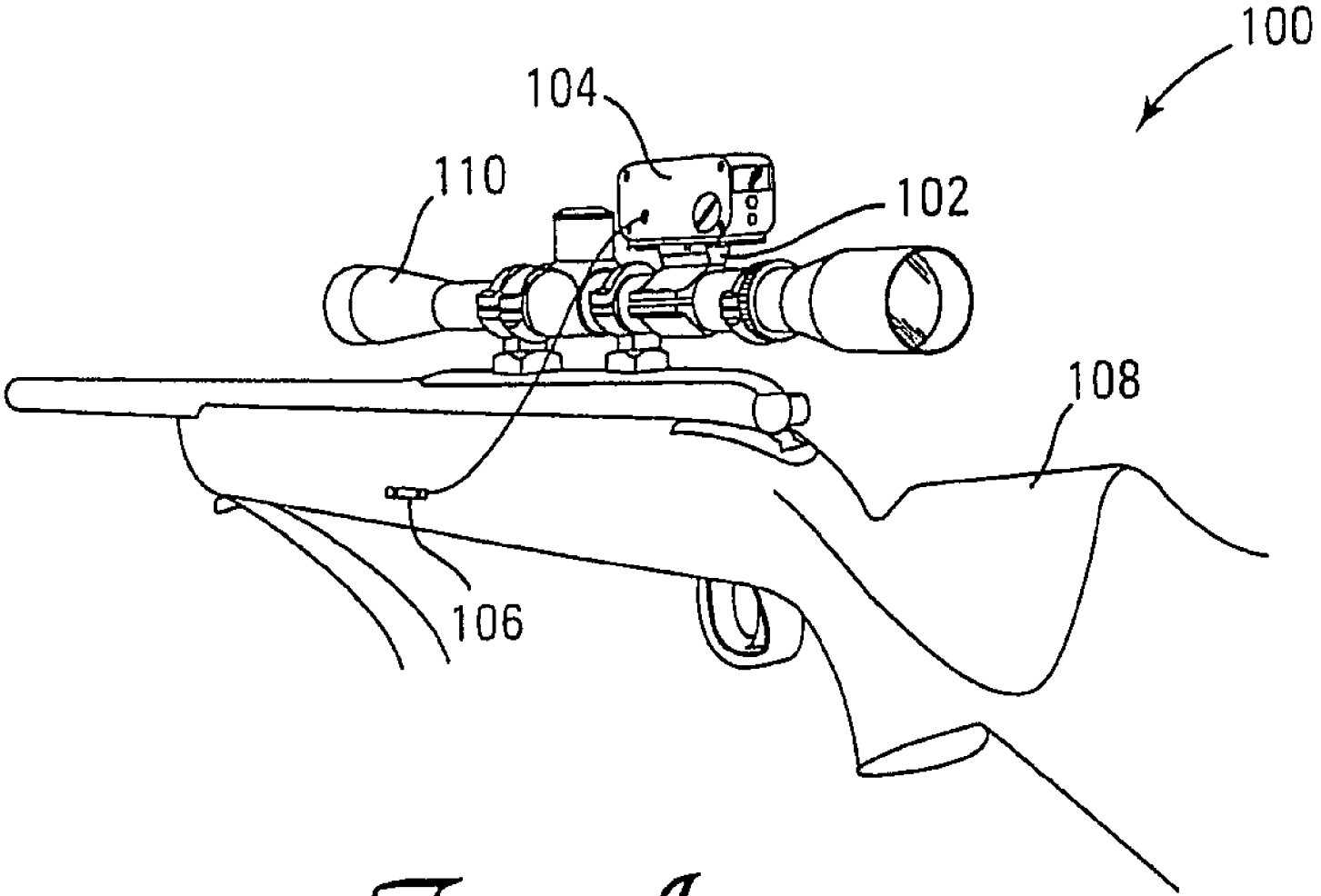
FIG. 1A is a side view of a mounting system of one embodiment of the present invention.
Figure 1B:
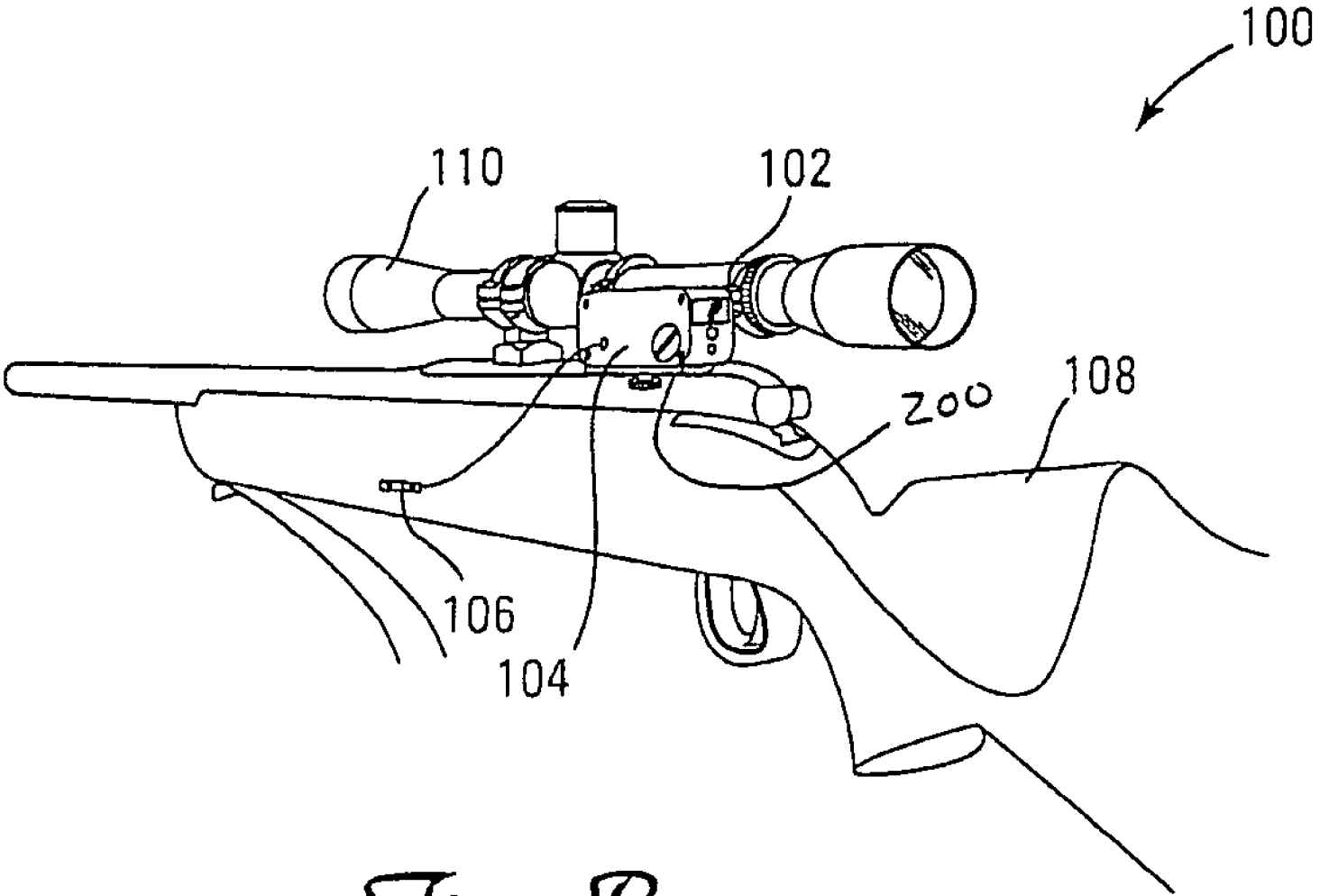
FIG. 1B is a side view of a mounting system of another embodiment of the present invention.

Referring to FIG. 1A, a mounting system 100 of one embodiment of the present invention is illustrated. The mounting system 100 in this embodiment includes a scope 110 that is mounted on a weapon, which is a rifle 108 in this example, and a scope mount 102. The electronic device is a rangefinder 104 in this example that can be operated remotely with a remote control pad 106. In the example of FIG. 1A, the rangefinder 104 is mounted over the scope 110 from a perspective of the hunter. Referring to FIG. 1B, an example of another embodiment in which the rangefinder 104 is mounted on the side of the scope 110 from the perspective of the hunter.

Figure 2B:
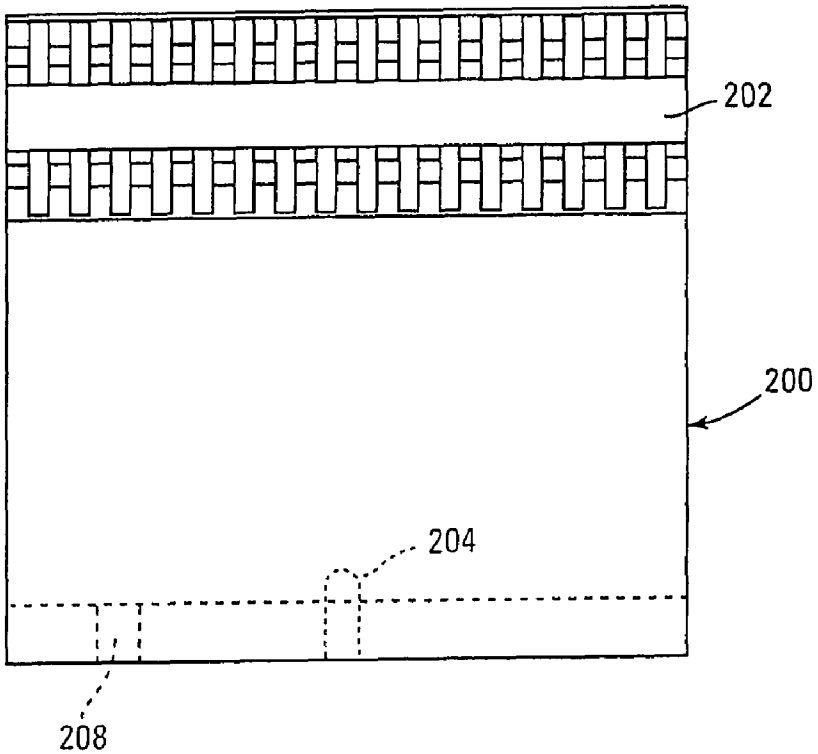
FIG. 2B is a back view of the mount of FIG. 2A illustrating a mounting rail of one embodiment of the present invention.
Figure 2A:
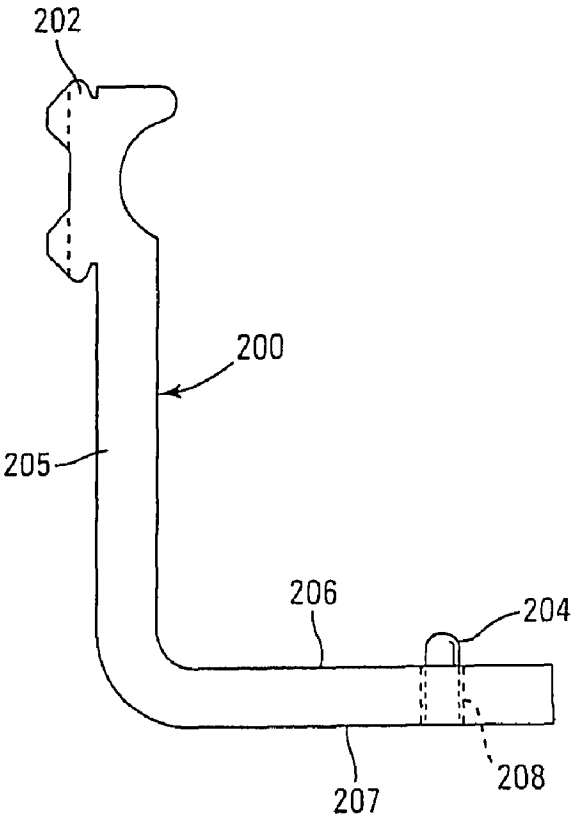
FIG. 2A is a side view of a mount of one embodiment of the present invention.
Figure 2C:
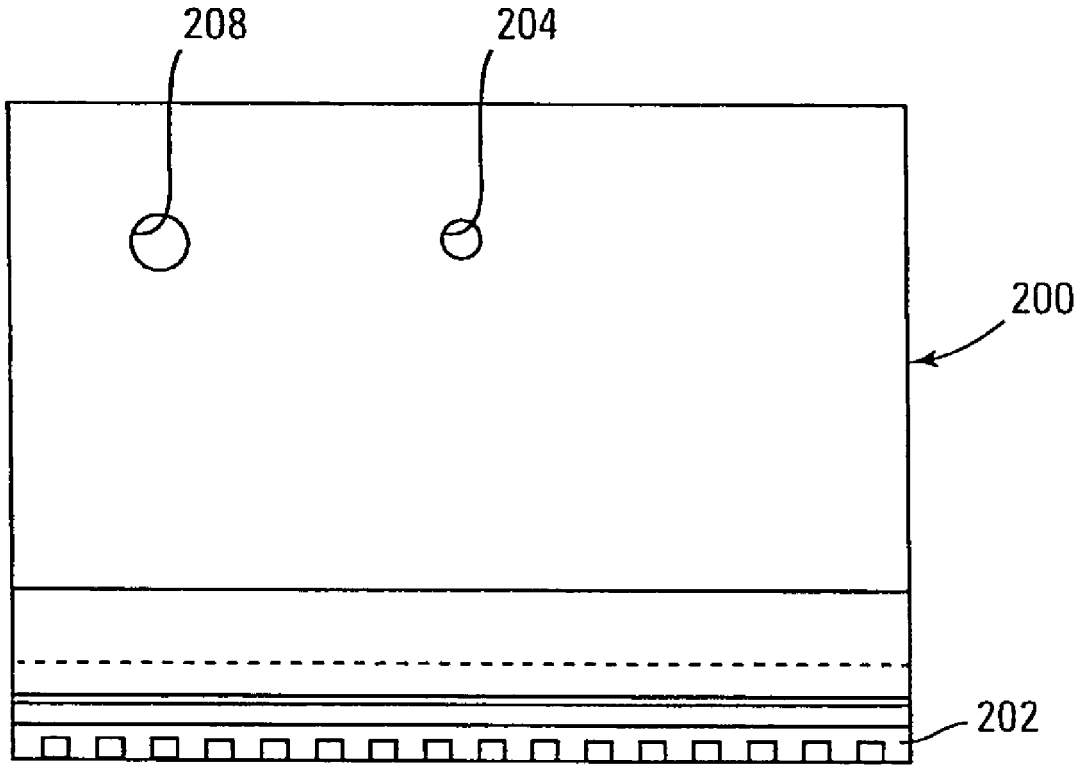
FIG. 2C is a top view of the mount of FIG. 2A.

FIG. 2A is a side view of a mount 200 of one embodiment of the present invention. The mount is used in embodiments of the present invention to mount a device to the weapon. The mount 200 includes a side plate 205 and a support plate 207 that generally makes the shape of an L. In particular, the support plate 207 extends from a first end of the side plate 205 at generally a right angle. The support plate 207 includes an engaging surface 206 to support a device and a stabilizing nub 204 designed to fit into a cavity of a device to provide stability and prevent the rotation of the device when mounted to the mount 200. The support plate 207 also includes a mounting aperture 208. The mounting aperture 208 is designed to allow a thumb screw (or any type of attaching device) to engage the device so that the device can be selectively coupled to the engaging surface 206 of the mount 200. The side plate 205 includes a mounting rail (or rail mount) 202 that is located near a second end of the side plate 205 that is opposite the first end of the side plate 205. As illustrated, the mounting rail 202 extends from the side plate 205 in a direction that is opposite the direction the support plate 207 extends from the side plate 205. FIG. 2B illustrates a back view of the mount 200 and in particular the mounting rail 202. FIG. 2C illustrates a top view of the mount 200 and in particular the stabilizing pin 204 and the mounting aperture 208.

Figure 3A:
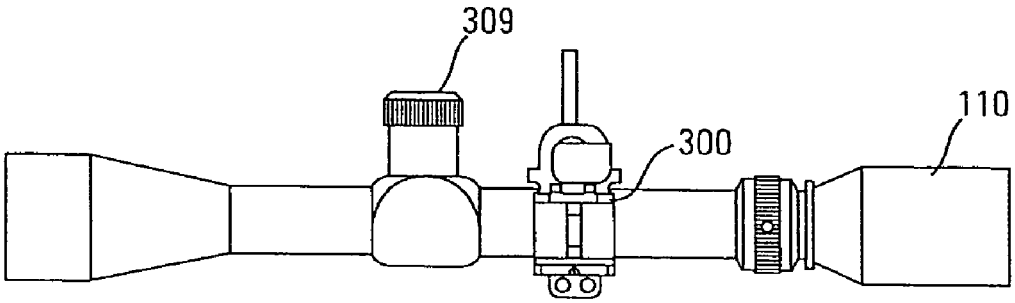
FIG. 3A is a side view of a scope mount with a locking rod mechanism.
Figure 3B:
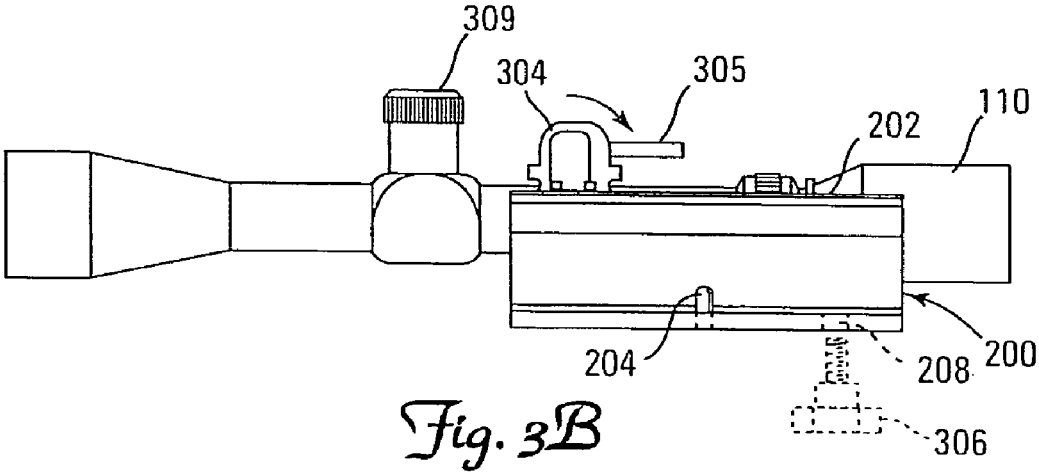
FIG. 3B is a side view of a scope mount engaging a mount of one embodiment of the present invention.
Figure 3C:
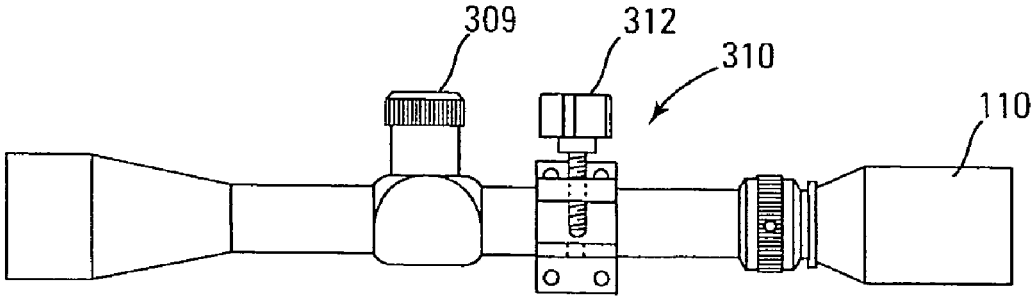
FIG. 3C is a side view of a scope mount with a thumb screw locking mechanism.

FIG. 3A illustrates a side view of a scope 110 with a quick mount scope mount 300 attached thereto. Also illustrated is the adjustment knob 304 of the scope 300 which adjusts the elevation and/or windage of the scope. It is important that the mount 200 and the device using the mount not interfere with the operations of the scope such as the operation of the adjustment knob 304. FIG. 3B illustrates a mount 200 coupled to the scope 110 via the scope mount 300. In particular, the scope mount 300 engages the mounting rail 202 of mount 200. In this embodiment, the scope mount 300 locks the mount onto the scope via a locking mechanism having a locking rod 305 that is rotated into a locking position. In the embodiment of FIG. 3C, a scope mount 310 of one embodiment of the present invention is illustrated. The scope mount 310 includes a threaded thumb screw 312 with a triangle shaped head. The triangle shaped head allows for the applying of a twisting pressure to selectively lock and unlock the scope mount 312 to the scope 110 without the use of a screwdriver.

Figure 4:
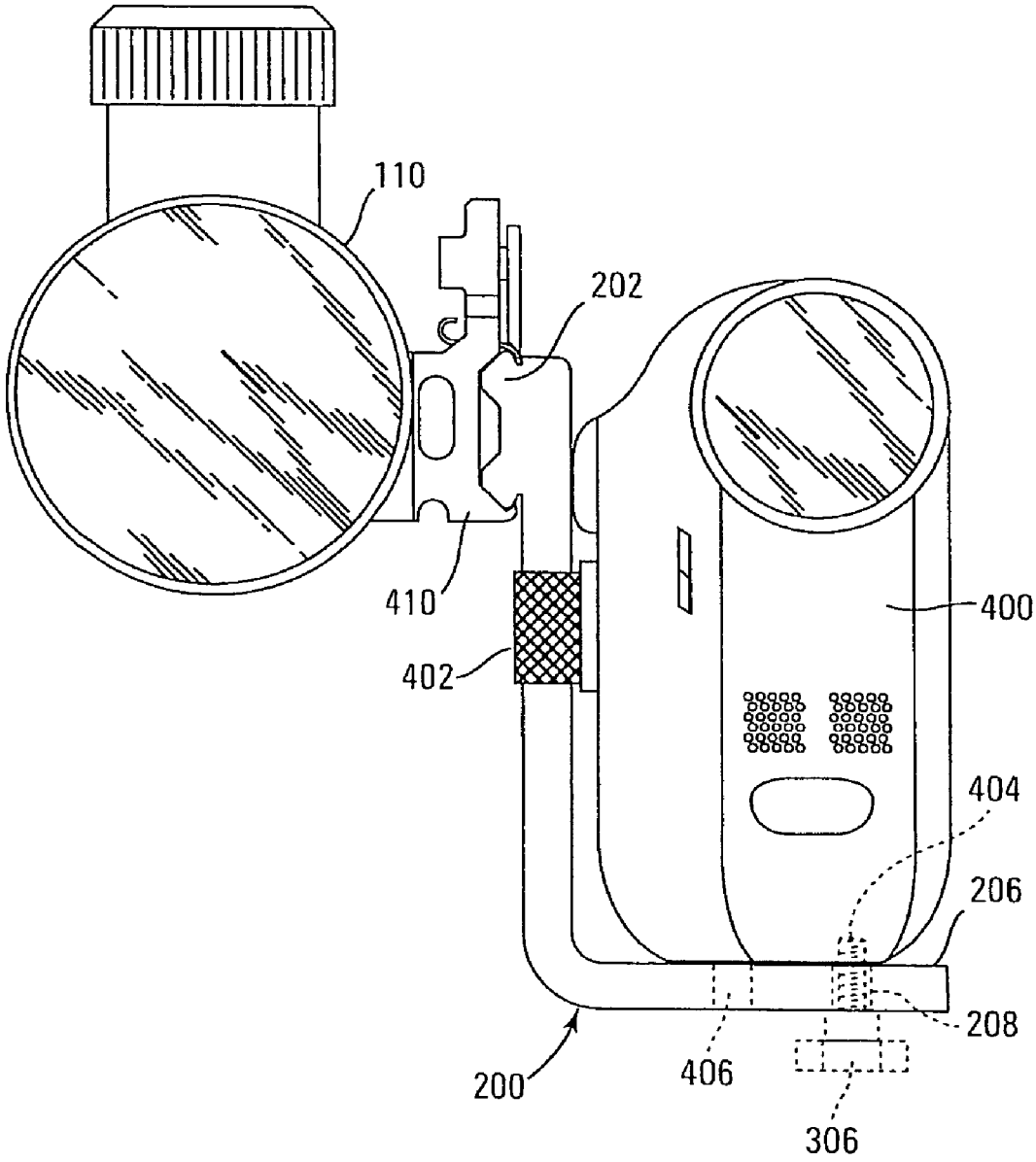
FIG. 4 is a front view of a mount of FIG. 2A attaching a camera to a scope.
Figure 5:
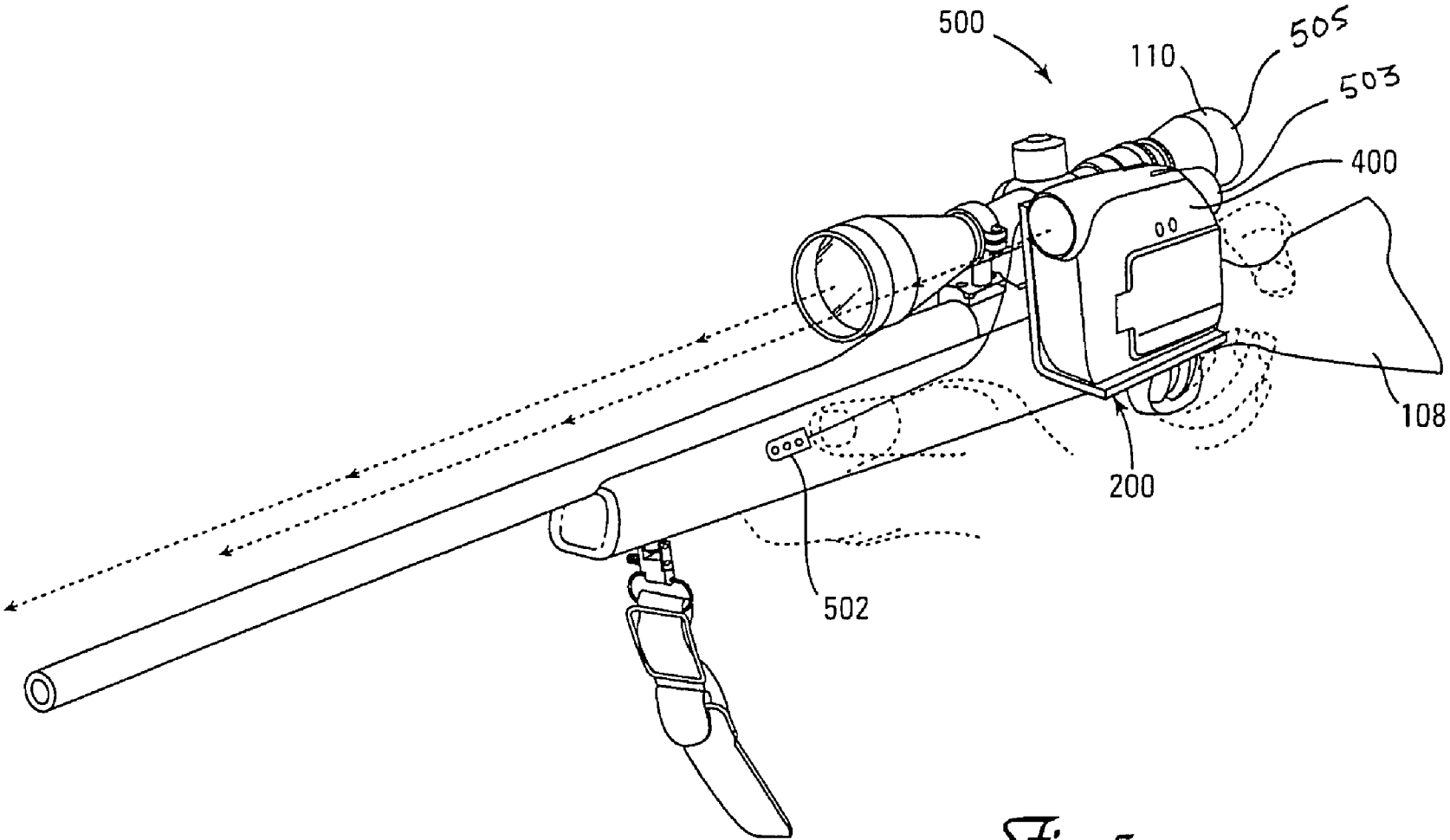
FIG. 5 is a side view of a mount of FIG. 2A attaching a camera to a rifle.

Referring to FIG. 4, a front view of the mount 200 attaching a video camera 400 to a scope 110 of one embodiment of the present invention is illustrated. As illustrated, a bottom side of camera 400 is positioned to abut the engaging surface 206 of the mount 200. The thumb screw mounting aperture 208 allows a triangular shaped head thumb screw 306 to be threaded into internal threads 404 of the camera 400 to secure the camera to the mount 200. Moreover, a hand strap 402 of the camera 400 can be wrapped around the mount as illustrated to further secure the camera to the mount 200. FIG. 4 further illustrates how the mounting rail 202 of the mount 200 is engaged with the scope mount 410. FIG. 5 illustrates the mounting system 500 on a rifle 108. As illustrated, the mount 20 allows for the camera to be mounted away from the elevation adjustment knob 309 of the scope 110. Moreover, as illustrated the eyepiece 503 of camera 400 is approximately at the same height as the eyepiece 505 of the scope 110 in relation to the hunter. That is, the eyepiece 503 of the camera 400 is basically at eye level with the aiming mechanism of the firearm. Accordingly, the hunter's movement to look between the scope and the view finder on the camera is minimal to avoid disruption of the hunt. This also applies to other devices such as a rangefinder with a display that is positioned relatively at eye level with the scope as illustrated in FIG. 1B. Also illustrated in FIG. 5 is a remote control pad 502 that is designed to control the camera 400.

Figure 6:
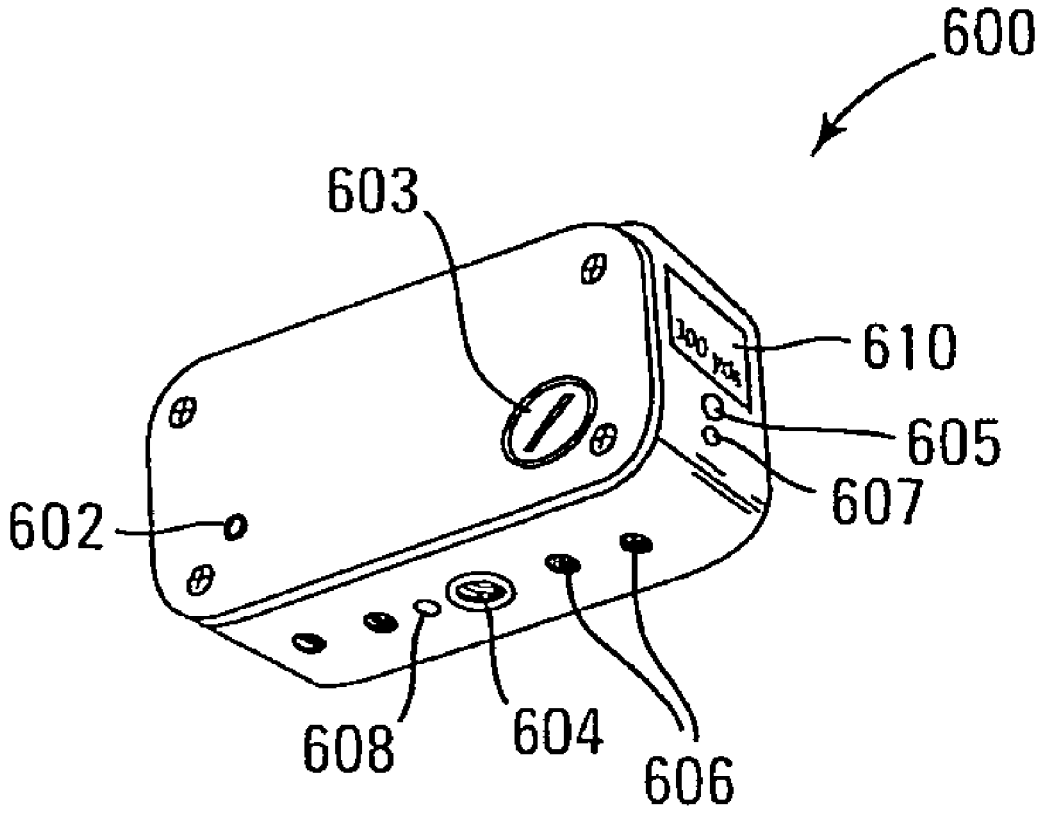
FIG. 6 is a side perspective view of a rangefinder of one embodiment of the present invention.

An example of a rangefinder 600 of one embodiment of the present invention is illustrated in FIG. 6. Rangefinder 600 includes attaching threads 604 adapted to engage the threads of a thumb screw. Accordingly, the rangefinder can be attached to the mounting plate 200 similar to the camera 400 of FIG. 4. This embodiment is illustrated in FIG. 1B. The rangefinder 600 also includes display 610, a power button 605, a mode switch button 607, a battery cover 603 and a remote control port 602 that allows for the remote operation of the rangefinder 600. Moreover, the bottom surface of the rangefinder 600 further includes 606 attaching apertures 606. The attaching apertures 606 are used to mount a mounting rail to the rangefinder 600. The bottom surface of the rangefinder 600 further includes a stabilizing recess 608 that is designed to receive a stabilizing nub such as the stabilizing nub 204 on mount 200. In this embodiment, the battery cover 603 and the remote control port 602 are positioned on a left side of the rangefinder 600 so that when the rangefinder 600 is mounted to a mount 200 as illustrated in FIG. 1B, the battery compartment and the port 602 are assessable. In another embodiment, where the mount 200 is mounted to the other side of the scope 110, the battery cover 603 and the remote control port 602 are positioned on a right side of the rangefinder 600 to allow access to the battery chamber and the port 602 when mounted to the mount 200 in this embodiment. In addition, as illustrated in FIG. 1B, the placement of the power button 605 and mode switch button 607 on a rear side of the rangefinder 600 allows for the ease of operation of the rangefinder 600 while the firearm is shouldered in a shooting position.

Figure 7A:
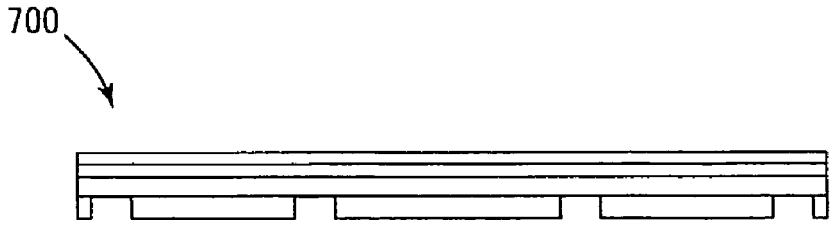
FIG. 7A is a side view of a mounting rail of one embodiment of the present invention.
Figure 7B:
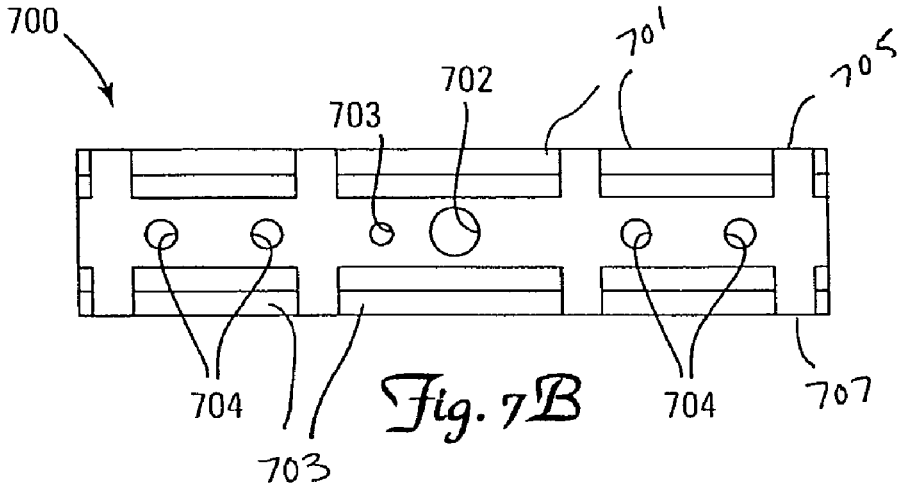
FIG. 7B is a top view of the mounting rail of FIG. 7A.
Figure 8:
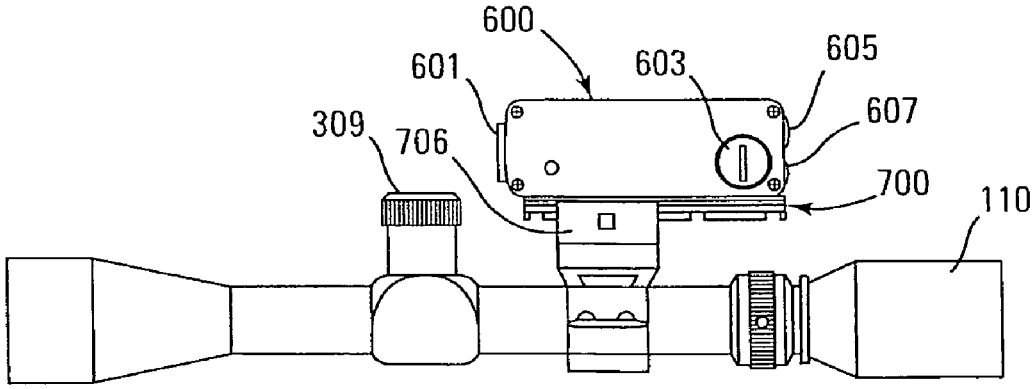
FIG. 8 is a side view of a rangefinder being attached to a scope of one embodiment of the present invention.
Figure 9:
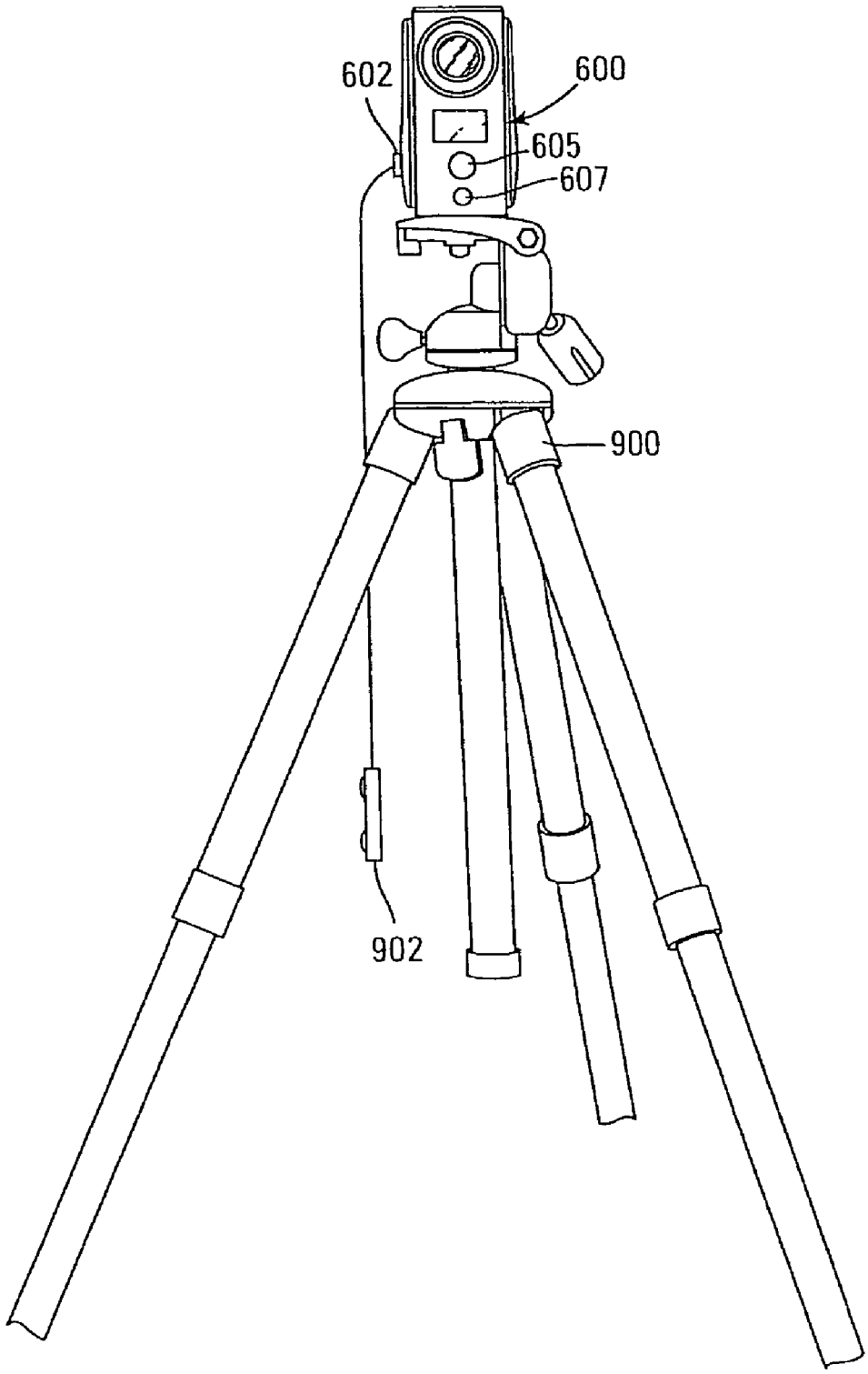
FIG. 9 is a front view of the rangefinder of FIG. 6 attached to a tripod.

An example of a mounting rail 700 of one embodiment of the present invention is illustrated in FIGS. 7A and 7B. The mounting rail 700 of this embodiment includes rail apertures 704 that are adapted to be aligned with the attaching apertures of the rangefinder 606 of other device. Screws or other attachment means are used to secure the rangefinder 606 to the mounting rail 700 through the rail apertures 704 and the associated attaching apertures 606. Further illustrated is a stabilizing recess 703. This stabilizing recess is also designed to receive a stabilizing nub such as the stabilizing nub 204 on mount 200. The rail apertures 704, stabilizing nub as well as a rail thumb screw aperture 702 are positioned between a first edge 075 and a second edge 707 of the mounting rail 700. Moreover as illustrated, a first rail 701 is positioned along the first edge 705 and a second rail 703 is positioned along a second edge 707 of the mounting rail 700. An illustration of a rangefinder attached to a scope 110 using the mounting rail 700 and a scope mount 706 is illustrated in FIG. 8. As illustrated in this embodiment, the mounting rail 700 is directly coupled to the scope mount 706. In other embodiments, the mounting rail 700 is coupled to a mount 200 that is coupled to the scope mount 706. In these embodiments, the mount rail thumb screw aperture 702 is used to connect the mounting rail 700 and rangefinder 600 to the mount 200 via a thumb screw. The attaching threads 604 of the rangefinder 600 can also be used to mount the rangefinder 600 to a tripod 900 as illustrated in FIG. 9. As also illustrated in FIG. 9, the rangefinder 600 can be remotely operated by a remote control pad 902 that is in communication with the remote control port 602.

Figure 10:
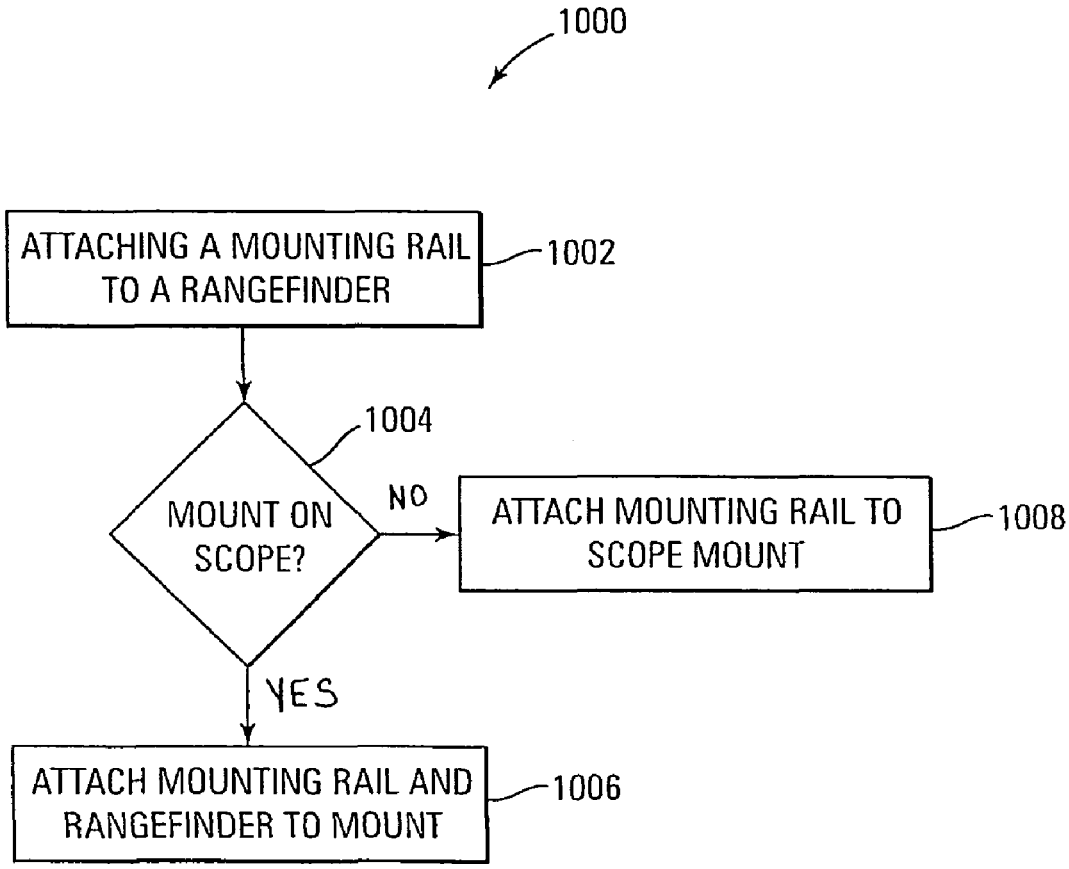
FIG. 10 is a flow diagram of one embodiment of the present invention.

One method of using a rangefinder 600 and a mount rail (or mounting rail) 700 of one embodiment of the present invention is illustrated in FIG. 10. As illustrated, the method begins by attaching a mounting rail 700 to the rangefinder 600 (1102). In one embodiment, as illustrated in FIGS. 6 and 8 the attachment is at the bottom of the rangefinder. This illustration however, is shown by way of example and not by limitation. Accordingly, the location of the attachment of the mounting rail 700 is not limited to the bottom of the rangefinder. It is then determined if a mount 200 is already on the scope (1004). If a mount 200 is not on the scope (1004), the mounting rail 700 is directly attached to a scope mount 706 as illustrated in FIG. 8. If a mount 200 is already on the scope (1004), the rangefinder 600 is attached to the mount 200 as illustrated in FIG. 1B.

Figure 11:
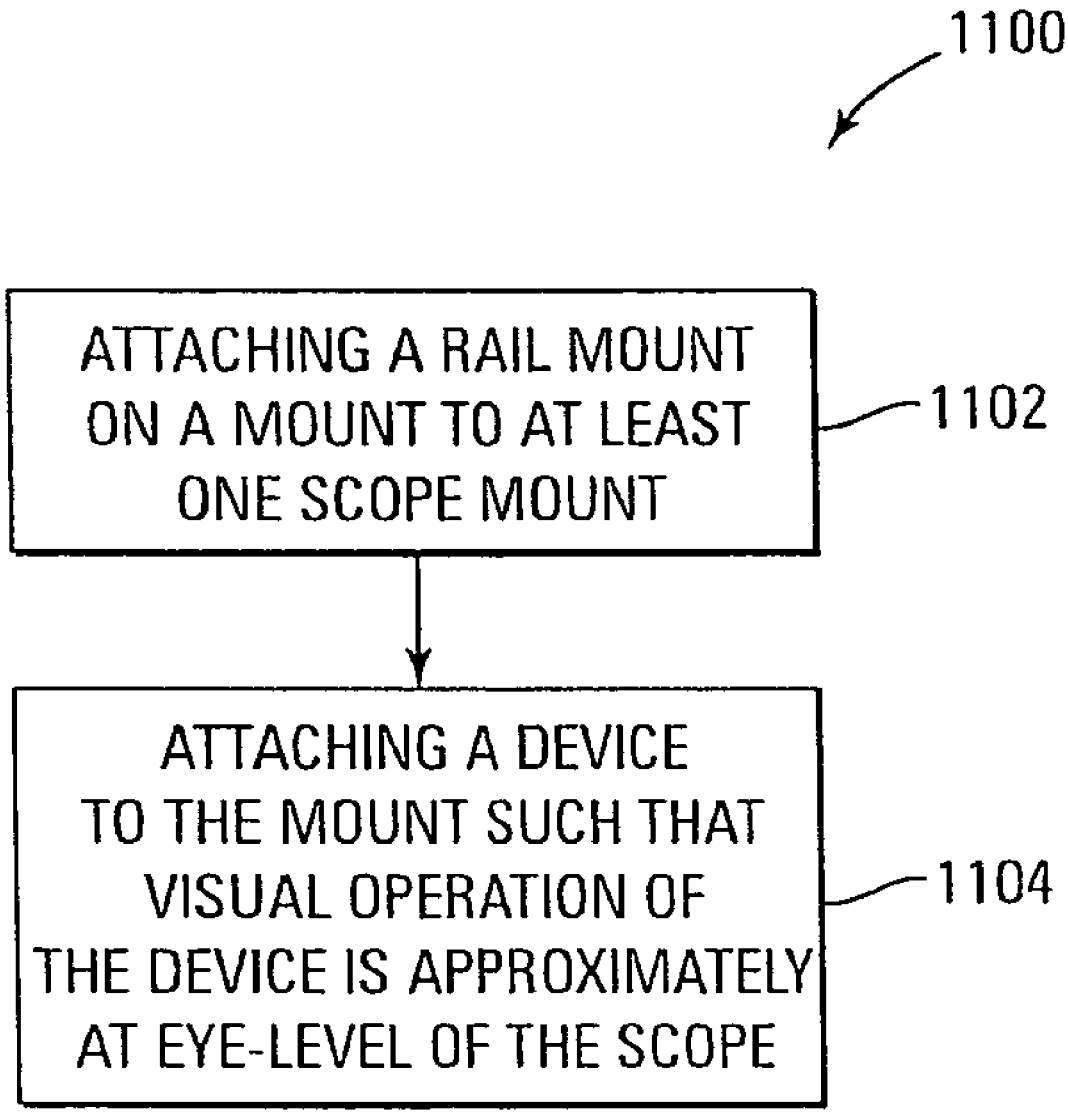
FIG. 11 is another flow diagram of another embodiment of the present invention.

As discussed above, the mount 200 can be used by a plurality of devices. One method of using the mount with devices in one embodiment of the present invention is illustrated in FIG. 11. As illustrated, a rail mount 202 on the mount 200 is first attached to at least one scope mount 304 (1101). This is illustrated in FIG. 3B. The device is then attached to the mount (1104). In one embodiment, the visual operation of the device is positioned by the mount to be at eye level with an aiming mechanism of the firearm which is in this embodiment, an eye piece of the scope. For example, as discussed above, with a video camera device 400 (of FIG. 5), the eyepiece 503 of the camera 400 is positioned approximately at eye level with the eyepiece 505 of the scope 110 and with the rangefinder example the display on the range finder is positioned approximately at eye level with the eyepiece of the scope (FIG. 1B).

Figure 12:
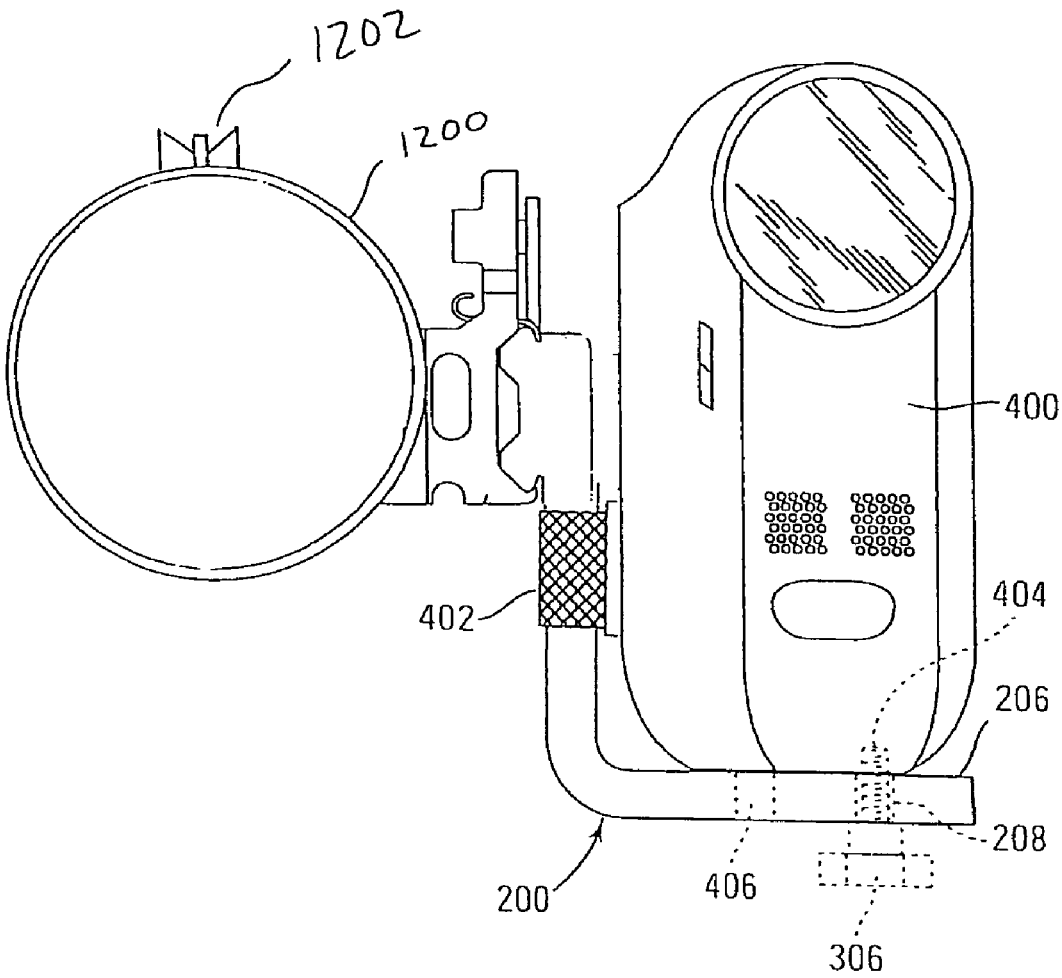
FIG. 12 is a front view of a mount of one embodiment of the present invention mounted to a barrel of a firearm.

Although, the above examples of the embodiments of the present invention illustrate a device being coupled to a scope of a firearm, other embodiments attach the device directly to a barrel of a firearm. For example, please refer to FIG. 12. In the embodiment of FIG. 12, a mount 200 is coupled directly to a barrel 1200 of a firearm via scope mount 410. That is, in this embodiment, the scope mount 410 is directly coupled to the barrel 1200 and not a scope. Also illustrated in FIG. 12 is the aiming mechanism 1210 of the firearm which is, in this embodiment, approximately at eye level with the operating device of the video camera 400. Accordingly, the above embodiments of the present invention are not limited to being mounted to a scope.

Although specific embodiments have been illustrated and described herein, it will be appreciated by those of ordinary skill in the art that any arrangement, which is calculated to achieve the same purpose, may be substituted for the specific embodiment shown. This application is intended to cover any adaptations or variations of the present invention. Therefore, it is manifestly intended that this invention be limited only by the claims and the equivalents thereof.

The invention claimed is:

1. A method of attaching a device to a scope mounted on top of a weapon by a first scope mount ring and a second scope mount ring, the method comprising:

securing the device to a support plate of a device mount; and attaching a mounting rail of the device mount to a third scope mount ring surrounding the scope by engaging two parallel rails of the mounting rail with two parallel rail receiving tracks on the third scope mount ring, the third scope mount ring being independent of the first scope mount ring and the second scope mount ring;

wherein the device is located approximately at eye level with an aiming device of the weapon;

wherein the support plate is substantially perpendicular to a scope longitudinal axis.

2. The method of claim 1, wherein securing the device to the device mount further comprises:

positioning a stabilizing nub on a plate of the device mount in a stabilizing recess extending into the device; and engaging a screw with a threaded attaching recess extending into the device, such that the support plate of the device mount is securely positioned between a head of the screw and the device when the screw is engaged with the threaded attaching recess.

3. The method of claim 1, wherein a display of the device is located approximately at eye level with the aiming device of the weapon.

4. The method of claim 1, wherein the device mount attaches the device on top of the weapon.

5. The method of claim 1, wherein the device mount attaches the device alongside the weapon.

6. The method of claim 1, wherein the device is a rangefinder.

7. The method of claim 1, wherein the device is a video camera.

8. The method of claim 1, wherein attaching the mounting rail of the device mount to the third scope mount ring includes clamping the third scope mount ring to the mounting rail.

9. The method of claim 8, wherein attaching the mounting rail of the device mount to the third scope mount ring includes securing the third scope mount ring to the mounting rail with a threaded screw.

10. The method of claim 1, further comprising:

detaching the mounting rail from the third scope mount ring without altering the first scope mount ring and the second scope mount ring.

11. A method of attaching a device to a scope mounted on top of a weapon by a first scope mount ring and a second scope mount ring, the method comprising;

attaching a mounting rail of a device mount to a third scope mount ring surrounding the scope by engaging two parallel rails of the mounting rail with two parallel rail receiving tracks on the third scope mount ring, the third scope mount ring being independent of the first scope mount ring and the second scope mount ring;

attaching the device to a support plate of the device mount, thereby coupling the device to the weapon through the scope;

wherein the device is located approximately at eye level with an aiming device of the weapon and the support plate is substantially perpendicular to a scope longitudinal axis.

12. The method of claim 11, wherein attaching the mounting rail of the device mount to the third scope mount ring includes clamping the third scope mount ring to the mounting rail.

13. The method of claim 12, wherein attaching the mounting rail of the device mount to the third scope mount ring includes securing the third scope mount ring to the mounting rail with a threaded screw.

14. The method of claim 11, wherein the device is mounted on top of the weapon.

15. The method of claim 11, wherein the device is mounted alongside the weapon.

16. The method of claim 11, wherein the device is a rangefinder.

17. The method of claim 11, wherein the device is a video camera.

18. The method of claim 11, further comprising:

decoupling the device mount from the third scope mount ring without altering how the scope is mounted to the weapon.

19. A method of attaching a video camera to a weapon, the method comprising:

securing the video camera to a support plate of a device mount;

strapping a strap of the video camera around a side plate of the device mount; and attaching a mounting rail of the device mount to at least one scope mount ring by engaging two parallel rails of the mounting rail with two parallel rail receiving tracks on the at least one scope mount ring; wherein the device is located approximately at eye level with an aiming device of the weapon;

wherein the support plate is substantially perpendicular to a scope longitudinal axis.

20. The method of claim 19, wherein attaching the mounting rail of the device mount to the at least one scope mount ring includes clamping the at least one scope mount ring to the mounting rail.

* * * * *